US008206164B2

(12) United States Patent
Sprenger et al.

(10) Patent No.: US 8,206,164 B2
(45) Date of Patent: Jun. 26, 2012

(54) SECURING DEVICE

(75) Inventors: Dennis Sprenger, Horn-Bad Meinberg (DE); Heinz Reibke, Bad Salzuflen (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 76 days.

(21) Appl. No.: 12/830,710

(22) Filed: Jul. 6, 2010

(65) Prior Publication Data

US 2011/0008983 A1 Jan. 13, 2011

(30) Foreign Application Priority Data

Jul. 7, 2009 (DE) ..... 10 2009 032 147

(51) Int. Cl.
*H01R 13/62* (2006.01)

(52) U.S. Cl. ..... 439/153; 439/352

(58) Field of Classification Search ..... 439/94, 439/153, 532, 709, 716, 715, 358, 835, 821, 439/352

See application file for complete search history.

(56) References Cited

U.S. PATENT DOCUMENTS

| | | | | |
|---|---|---|---|---|
| 4,735,583 | A * | 4/1988 | Rudy et al. | 439/350 |
| 5,163,848 | A | 11/1992 | Maeda | |
| 5,192,225 | A | 3/1993 | Suzuki | |
| 5,382,177 | A * | 1/1995 | Hutchinson et al. | 439/358 |
| 5,486,117 | A * | 1/1996 | Chang | 439/357 |
| 5,941,726 | A * | 8/1999 | Koegel et al. | 439/358 |
| 6,506,071 | B2 | 1/2003 | Lange | |
| 7,537,496 | B2 | 5/2009 | Bentler et al. | |
| 7,753,739 | B2 | 7/2010 | Bentler et al. | |
| 2002/0098732 | A1 | 7/2002 | Shimizu | |
| 2007/0026721 | A1 * | 2/2007 | Whyne et al. | 439/358 |

FOREIGN PATENT DOCUMENTS

| | | | |
|---|---|---|---|
| DE | 19814771 | A1 | 10/1998 |
| DE | 10045498 | C2 | 11/2002 |
| DE | 60027847 | T2 | 12/2006 |
| DE | 202007004414 | U1 | 5/2007 |
| DE | 102006003064 | A1 | 9/2007 |
| DE | 102008009986 | A1 | 7/2009 |
| FR | 2691216 | A1 | 11/1993 |

OTHER PUBLICATIONS

European Search Report EP 2 273 626 A1 , dated Oct. 28, 2010.

* cited by examiner

*Primary Examiner* — Edwin A. Leon
(74) *Attorney, Agent, or Firm* — Leydig, Voit & Mayer, Ltd.

(57) ABSTRACT

A securing device for a plug unit configured to automatically establish a secured state when the plug unit is plugged in includes an engagement element configured to automatically trigger the secured state through an engagement when the plug unit is plugged in, the automatically established secured state corresponding to a first stable position of the securing device, and an actuatable releasing device configured to unplug the plug unit. The actuatable releasing device is configured to actuate so as to undo the secured state and move the securing device into a second stable position. An unplugging and plugging in of the plug unit enables the securing device to move out of the second stable position.

14 Claims, 10 Drawing Sheets

SECURING DEVICE

CROSS-REFERENCE TO RELATED APPLICATIONS

This application claims the benefit of priority under 35 U.S.C. 119 (b) to a German Application No. DE 10 2009 032 147.0, filed Jul. 7, 2009, which is hereby incorporated herein by reference in its entirety.

FIELD

The invention relates to a securing device for a pluggable and unpluggable plug unit, whereby the secured state is automatically established when the plug unit is plugged in.

BACKGROUND

Electric series terminals may consist of a base terminal that constitutes the stationary part of the electric series terminal that is usually latched onto a mounting rail. A connecting plug constitutes the movable part of the electric series terminal. This connecting plug is plugged into matching slots of the base terminal and it should be possible to unplug it again from said base terminal. In the plugged-in state, a secure electric contact should exist between the contact elements of the plug and the corresponding contact elements of the base terminal.

This can be achieved in that a connecting plug, which generally consists of several disc-shaped plug terminal parts that make up a block, has laterally attached fastening covers with a screw receptacle, making it possible to insert screws in order to screw the connecting plug in the plugged-in state into the slot of the base terminal. These screws are screwed into threaded inserts of the attachment base terminals that—like the fastening covers of the plugs—laterally delimit corresponding disc-shaped base terminal parts that make up a block and that, combined in this manner, define the matching slot of the base terminal.

A tool such as, for example, a screwdriver is necessary in order to be able to screw the corresponding connecting plug by means of the screws into the attachment base terminals that belong to the matching slot and to thus establish a secured state. A tool such as a screwdriver is once again necessary in order to undo this secured state—that is to say, when the connecting plug is to be removed.

An embodiment of an electric series terminal or corresponding series terminal blocks that has become known in this form is from German patent application DE 10 2006 003 064 A1. In this context, it should also be mentioned that the attachment base terminal used there can have two threaded inserts, so that, in each case, only one attachment base terminal is needed for two adjacent slots, since the screw receptacles of the fastening covers can be arranged on opposite sides of the connecting plugs so as to be appropriately offset relative to a mid-line.

Moreover, German patent specification DE 100 45 498 C2 describes an electric series terminal whose connecting plug can be plugged into the corresponding base terminal and which can be secured in the plugged-in state. In the case of this existing series terminal, it is not necessary to use a tool to establish the plugged-in state, since the connecting plug is provided with a fastening element such as a springy latching arm, so that, when the connecting plug is plugged into the base terminal, it is automatically brought into the secured state since the springy latching arm has a tab that latches underneath a projection of the housing of the base terminal. In order to undo this secured state, that is to say, when the connecting plug is to be unplugged, it is necessary to press onto a part of the latching arm that projects considerably beyond the connecting plug while the connecting plug is being unplugged. Since the pressure on the latching arm has to be exerted during the entire time while the connecting plug is being unplugged, this is felt to be extremely inconvenient.

SUMMARY

In an embodiment, the invention provides a securing device for a plug unit configured to automatically establish a secured state when the plug unit is plugged in. The securing device includes an engagement element configured to automatically trigger the secured state through an engagement when the plug unit is plugged in, the automatically established secured state corresponding to a first stable position of the securing device, and an actuatable releasing device configured to unplug the plug unit. The actuatable releasing device is configured to actuate so as to undo the secured state and move the securing device into a second stable position, an unplugging and plugging in of the plug unit enabling the securing device to move out of the second stable position.

BRIEF DESCRIPTION OF THE DRAWINGS

While the appended claims set forth the features of the present invention with particularity, the invention and its advantages are best understood from the following detailed description taken in conjunction with the accompanying drawings, of which:

DETAILED DESCRIPTION

Figure 1B:
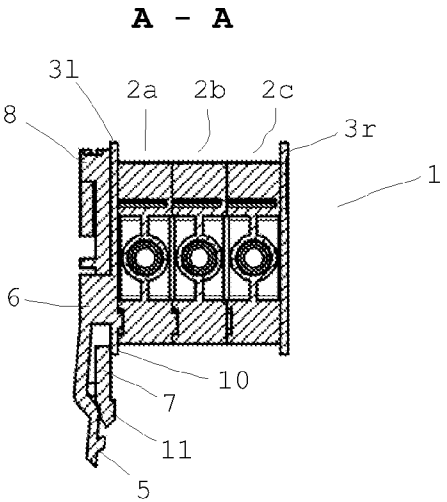
FIGS. 1*a*-1*c* show the connecting plug that is not yet plugged into the base terminal.
Figure 1B:
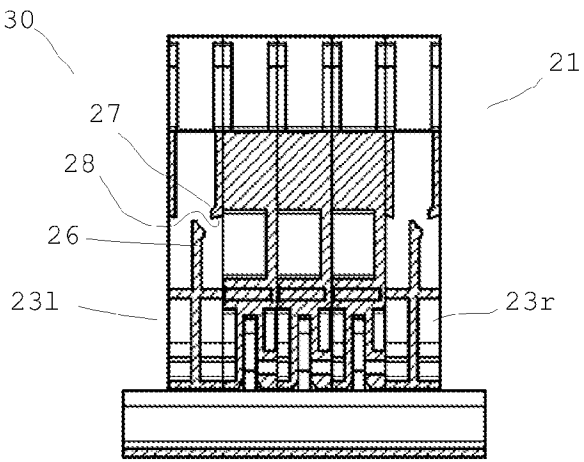
Figure 1A:
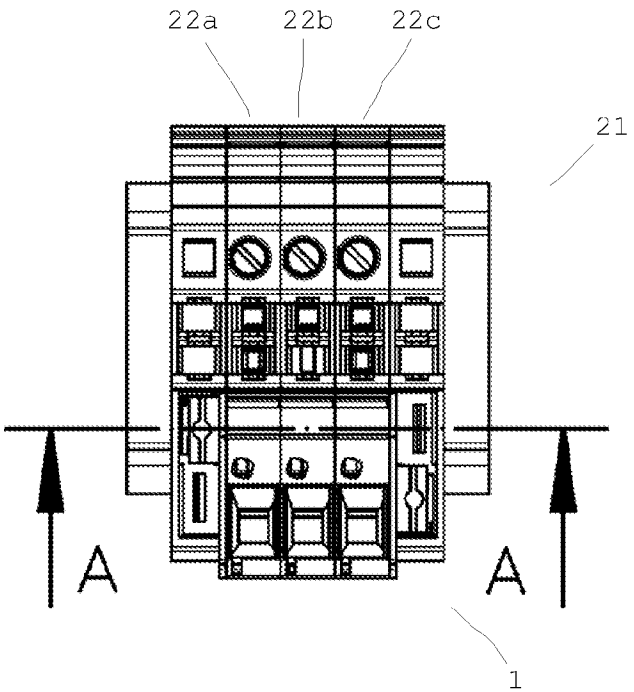

Embodiments of the invention present a securing device for a pluggable and unpluggable plug unit, said securing device being easy to handle.

The securing device according to the invention is provided for a pluggable and unpluggable plug unit. The secured state of the plug unit is established automatically when it is plugged in. For this purpose, the securing device has an engagement element that triggers the secured state. Through the engagement of the engagement element when the plug unit is plugged in, an automatically occurring secured state—corresponding to a first stable position of the securing device—can be established. In order to unplug the plug unit, an actuatable releasing device is provided that, when actuated, undoes the secured state and, at the same time, moves the securing device into a second stable position in such a way that this second stable position of the securing device, which can be considered as an unlocked position, can be undone and, in particular, is actually undone only after the plug unit has been unplugged and plugged in once again.

The plug unit can especially be a connecting plug. The base unit into which the connecting plug can be plugged in and from which it can be unplugged is usually stationary. The base unit can especially be a base terminal of an electric series terminal.

A stable position as set forth in this application refers to a position that does not release itself of its own accord.

The securing device according to the invention can advantageously be manipulated without a tool, that is to say, by actuating the releasing device by pressing it once with a finger in such a way that the unlocked position can be reached. Moreover, in a further advantageous manner, this unlocked position is once again undone when the plug unit is plugged into the base unit. When the plug unit is completely plugged into the base unit, then the envisaged secured state is very advantageously established in that this secured state is autonomously or automatically established.

It is preferably provided that the releasing device can be actuated from outside of the plug unit, especially towards the plug-in direction of the plug unit. This translates into especially easy operability, for example, if the entire securing device is arranged parallel to the plug-in direction next to the plug unit, and a head-shaped actuator of the releasing device projects beyond the plug unit.

If the pluggable plug unit is located in the base unit, it is advantageously provided that the releasing device has a linearly guided element such as a slide, that enables the release of the engagement element of the securing device. Then the second stable position of the securing device can also be reached, so that the plug unit can be unplugged from the base unit.

Once the plug unit has been unplugged from the base unit, the second stable position of the securing device, that is to say, the unlocked position, is initially retained. Therefore, in an advantageous manner, it is provided that the linearly guided element of the releasing device is pushed back into its initial position when the plug unit is plugged into the base unit, so that the second stable position of the securing device can be undone. In this manner, the securing device is "primed" to engage once again with the engagement element.

It is advantageous for a latching hook to be provided as the engagement element that triggers the secured state and said latching hook can, in fact, already itself have a pre-tensioning that assists the engagement, but the effective force of the engagement of the latching hook is even further intensified if a springy element is provided in the base unit that, when the plug unit is plugged into the base unit, is moved into a tensioned position by the rear wall of the latching hook itself.

Additional refinements of the securing device according to the invention are provided when the plug unit is configured as a connecting plug, and when the base unit is configured as a base terminal of a series terminal.

Consequently, it is, in fact, advantageous for the connecting plug to have at least one side wall, one guide shaft or latching flange with a latching hook shaped onto it in one piece, and also for the slide to be accommodated in the latching flange, said slide also being connected to a head part which, when the releasing device is released, especially towards the plug-in direction of the plug unit, can be actuated in such a way that the unlocked position or second stable position can be reached.

Moreover, it is advantageous for at least one lateral base flange to be provided on the base terminal, whereby said latching flange can be inserted into the base flange so that the latching hook formed thereon engages in a free space underneath a shoulder of a receiving shaft, whereby a spring arm that intensifies the engagement force of each latching hook is provided in the appertaining receiving shaft.

In an advantageous manner, it is provided in this context that each base flange attached on each side has two receiving shafts, so that latching flanges of adjacent connecting plugs can be inserted into one of the receiving shafts. This entails the advantage that base terminals can be arranged next to each other and that only one base flange has to be inserted between the adjacent base terminals, since one base flange has two receiving shafts. The receiving shafts of a base terminal do not have to be separated with respect to each other. It is sufficient if spaces are provided that are suitable to each accommodate a latching flange and that have the appertaining spring arm.

If the base terminal is especially supposed to have base flanges laterally—on the left and on the right—and, for example, two securing devices, and if an matching connecting plug is to have suitably matching latching flanges, then it is highly advantageous for their head parts to be configured so that they can be easily distinguished on the basis of their color and their different size from the plugs that are adjacent to them.

Preferably, the securing device in question projects beyond the matching latching flange and especially beyond its head part. Thus, a clear matching is achieved.

The invention will be described below with reference to an embodiment, whereby the plug unit is a connecting plug of an electric series terminal, and the base unit is a base terminal of the electric series terminal.

A brief description of FIGS. 1 through 10 will be given below. FIGS. 1 through 9 show the connecting plug and the base terminal in various positions relative to each other that take the operational sequence into account.

FIG. 1 shows:

a) a top view of the connecting plug with a base terminal located below it and having the associated section line A-A for the figure part shown under b), b) a sectional drawing of the connecting plug and the base terminal along the section line A-A from the figure part a), and c) a perspective view of the connecting plug and the base terminal, whereas FIGS. 2 through 9 show the sectional drawing of the connecting plug and the base terminal in figure part a), and the perspective depiction of the connecting plug and the base terminal in figure part b).

Below, reference is first made primarily to FIG. 1 in order to describe the components in a version of the invention according to the embodiment.

A connecting plug 1 comprises—here three—disc-shaped plug terminal parts 2*a*, 2*b* and 2*c* that are latched together and that form a block. Side walls 31 and 3*r* are employed that are usually to the left and right of the block and that are also latched to the plug terminal parts of the block.

On the left-hand side wall 31, as the sectional views b) of FIG. 1 and a) of FIGS. 2 through 9 clearly indicate, there is also an engagement element for securing the engaged position of the connecting plug 1 in the base terminal 21, which will be described in greater detail below. Such an engagement element can also be attached on the right-hand side wall 3*r*.

In FIG. 1*b*) and in the figure parts a) of FIGS. 2 through 9, a latching hook 5 can be seen which assumes this function of the engagement element of the securing device. The entire latching hook 5 is connected in one piece to a guide shaft 6 which is left open in a side area and which, once again in a suitable manner, can be connected or latched to the side wall 31 and/or to the side wall 3*r*.

A bar-like element 7, which can also be considered to be a slide and which will be designated as such below, is arranged in the guide shaft 6.

A relatively narrow side area 7*a* of the entire length of the slide 7 projects, on a side area, out of the area of the guide shaft 6 that is left open. As is shown in FIGS. 3 through 8, to which reference will be made again below, a head part 8 of the slide 7 projects to a maximum extent beyond an—upper—shaft inlet opening 9. For the rest, the head part 8 has a larger cross section than the rest of the slide 7, so that, at the same time that the cross section of the head part 8 increases abruptly relative to the rest of the slide 7, the inlet depth of the slide 7 into the guide shaft is limited.

The tip 11 of the slide 7 projects out of a—lower—shaft outlet opening 10 and this tip 11 has a suitable shape in accordance with the functions that it has to fulfill and that will be explained in greater detail below in the sectional drawings under a) of FIGS. 2 through 9.

The sectional view of FIG. 1 *b*) (top) shows that the slide 7—which is in the lowermost position with its tip 11—deflects the latching hook 5 against its elastic pre-tensioning, away from a corresponding side wall, such as 31, of the terminal block 2*a*-2*c*.

A base terminal 21 comprises—here three—disc-shaped base terminal parts 22*l*, 22*b*, 22*c* that are latched together and that form a block. Base flanges 23*l* and 23*r* are provided on the left and right of this block.

Each side of each base flange 23*l* and 23*r* has two receiving shafts 24*l*, 24'*l* as well as 24*r*, 24'*r*, each with a cross section opening that is, in any case, larger than the outer cross section of the guide shaft 6, including the latching hook 5 that is connected to it and including the side area 7*a* of the slide 7 that projects laterally from the guide shaft 6.

Figure 1C:
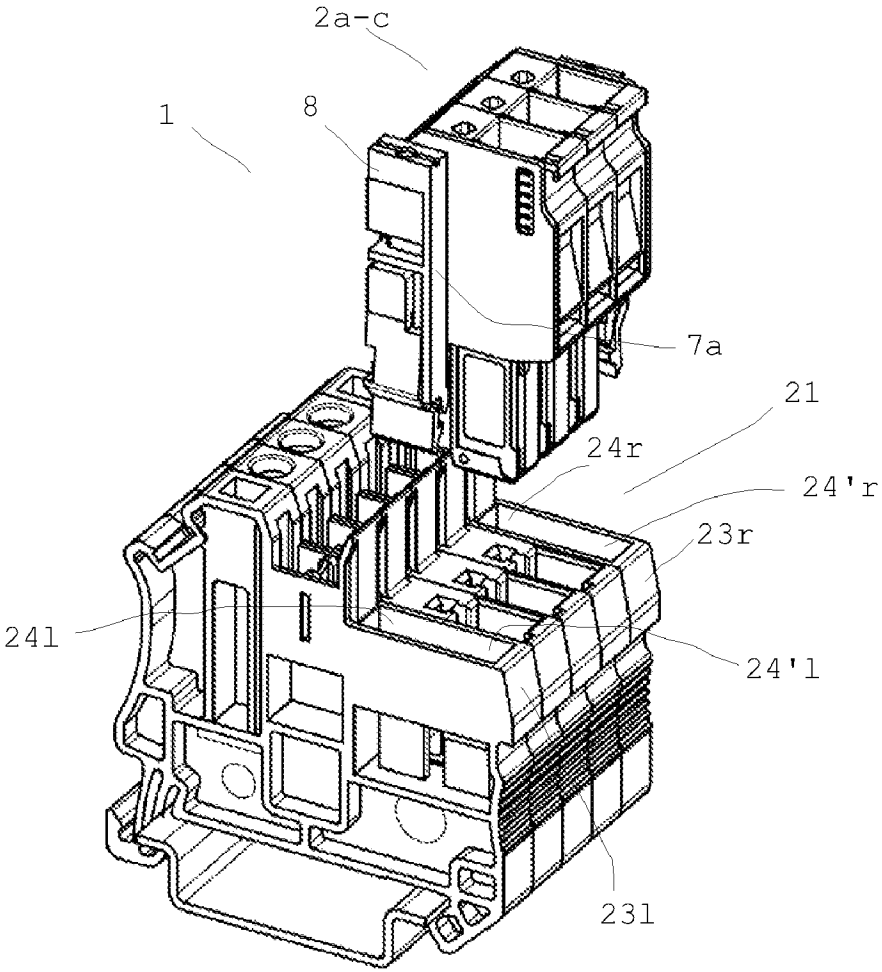

It should be pointed out that the receiving shafts, such as 24*l* and 24'*l*, of a base flange 23*l* do not have to be separated from each other. Thus, these can merely be areas that are to be associated in an imaginary manner with a single receiving shaft, as is also indicated in FIG. 1*c*.

Figure 6B:
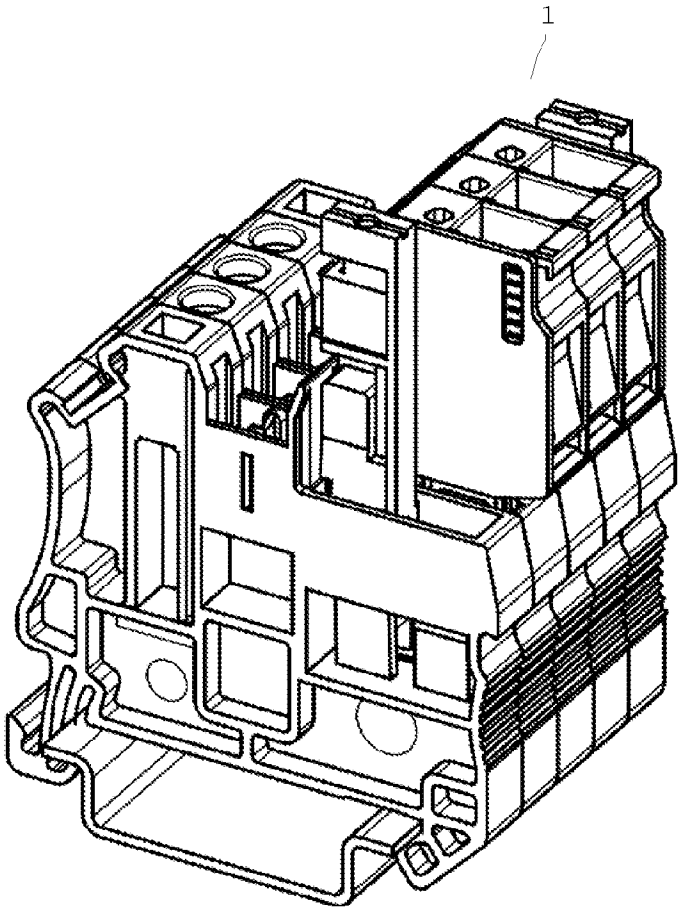
FIGS. 6*a*-6*b* show the connecting plug that is largely plugged into the base terminal, but that additional changes have occurred in the area of the latching hook.
Figure 6A:
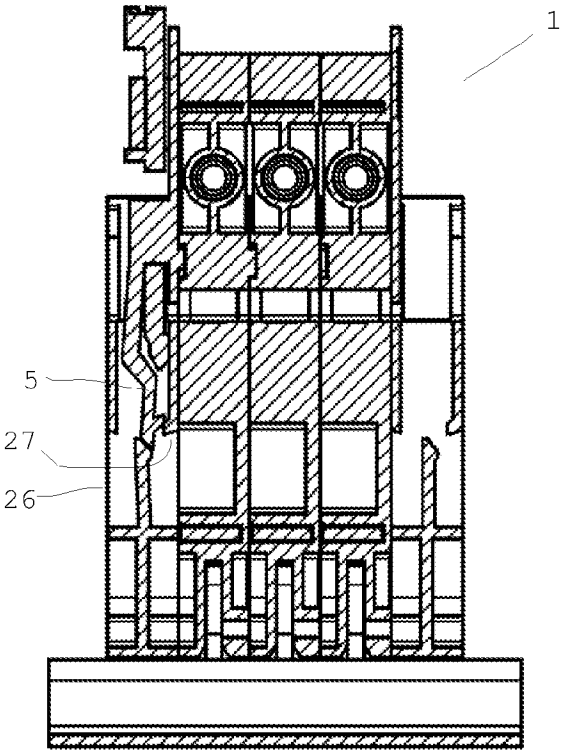
Figure 7B:
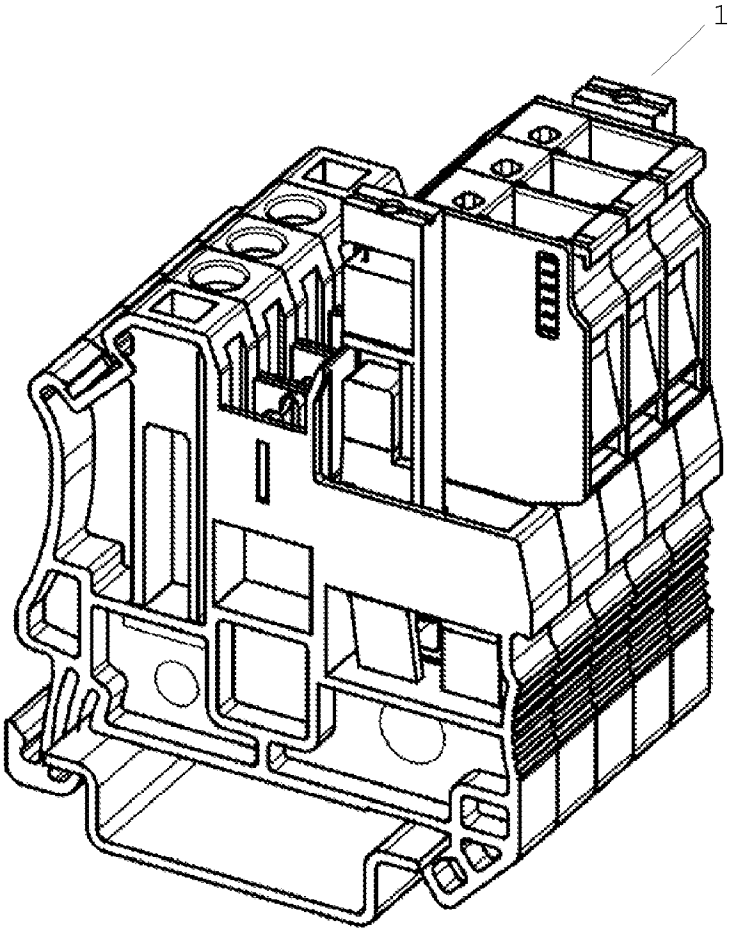
FIGS. 7*a*-7*b* show the connecting plug that is largely plugged into the base terminal, but that even more changes have occurred in the area of the latching hook.
Figure 7A:
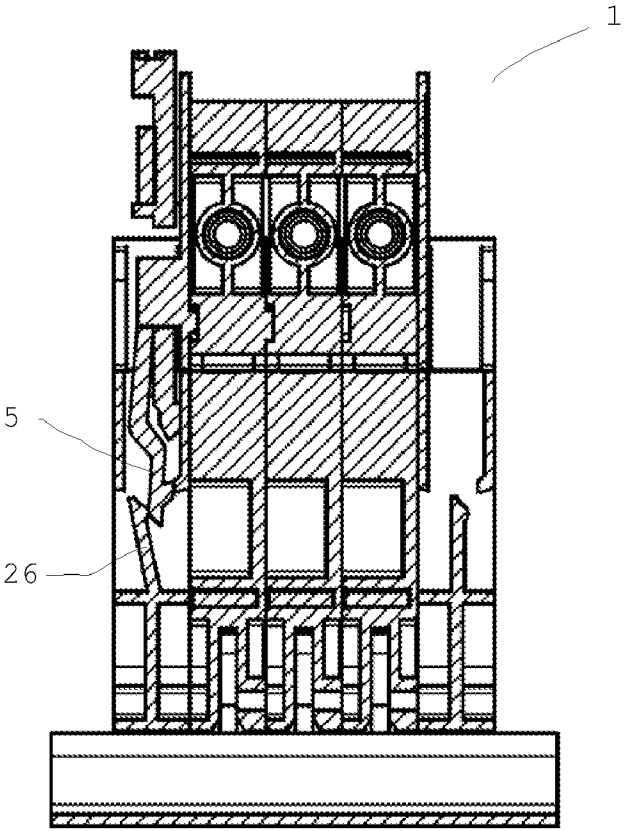
Figure 8B:
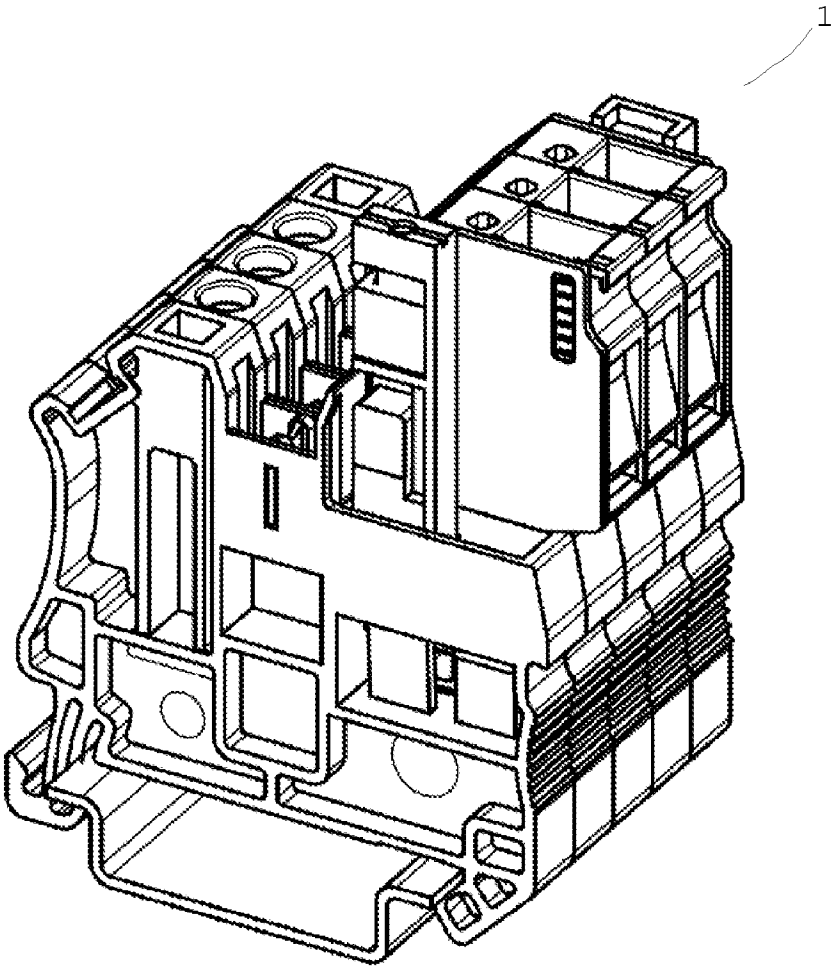
FIGS. 8*a*-8*b* show the connecting plug that is completely plugged in and latched into the base terminal.
Figure 8A:
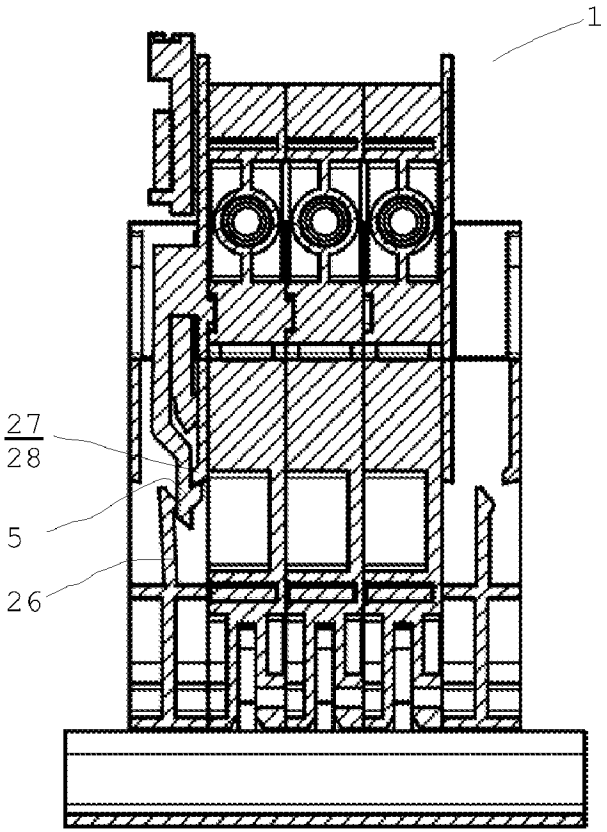

Thus, aside from the contact connection between the plug terminal parts 2*a*, 2*b* and 2*c* of the connecting plug 1 and the corresponding base terminal parts 22*a*, 22*b* and 22*c* of base terminal 21 in the completely plugged-in state, see FIG. 8, the guide shaft 6 should be inserted completely into the corresponding receiving shaft 24 from the outside as clearly shown here in the sectional drawings b) of FIG. 1, and 24*l* in a) of FIGS. 2 through 9.

However, it should be pointed out here that, if a connecting plug also has a guide shaft 6 on the side wall 3*r*, then said guide shaft 6 is installed so as to be offset by an imaginary line of symmetry. Thus, of the total of four available receiving shafts or shaft areas, only the receiving shafts 24*l* and 24'*r* are needed for a connecting plug 1.

Thus, the receiving shafts 24'*l* and 24*r* for receiving the guide shafts 6 as well as latching hooks 5 associated with them are also available for additional connecting plugs that are to be added to the left and right of the connecting plug 1 shown in the drawing. Furthermore, additional base terminals can be provided to the left and right of the base terminal 21 shown in the drawing, without there being a need to provide additional base flanges.

The brief description of FIGS. 1 through 9 will now be augmented to the extent necessary to explain the mode of operation as well as the additional parts that are essential from a functional standpoint.

In FIG. 1, the connecting plug 1 has not yet been plugged into the base terminal 21. It is possible that the connecting plug is being plugged into the base terminal for the first time, but especially in FIG. 1, it is being assumed that service work was carried out on a consumer connected to the connecting plug 1 and that this service work has now been completed, so that the consumer is once again supposed to be put into operation by a control unit that is connected to contacts of the base terminal 21, e.g. in a switchgear cabinet.

It can be clearly seen from the sectional view A-A that the latching hook 5 is still being pushed away or opened against its elastic pre-tensioning by the slide 7 that is still in its depressed state. The securing device is still in the unlocked position from the last time when the connecting plug 1 was unplugged from the base terminal 21.

Figure 2B:
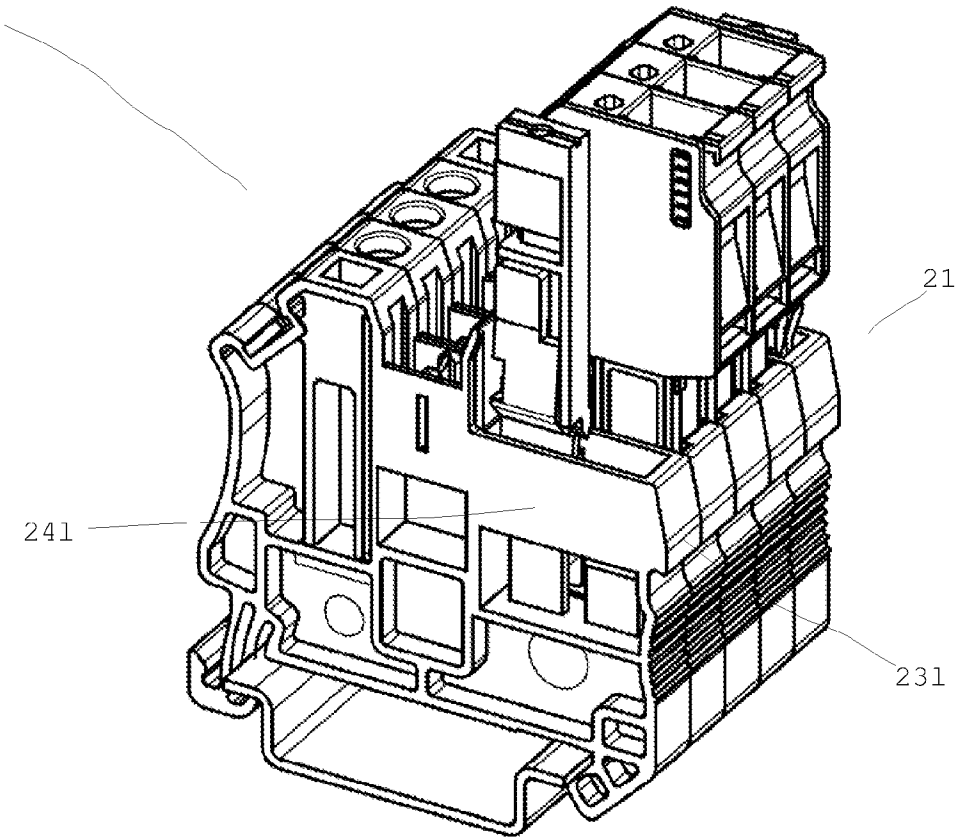
FIGS. 2*a*-2*b* show the connecting plug that is partially plugged into the base terminal.
Figure 2A:
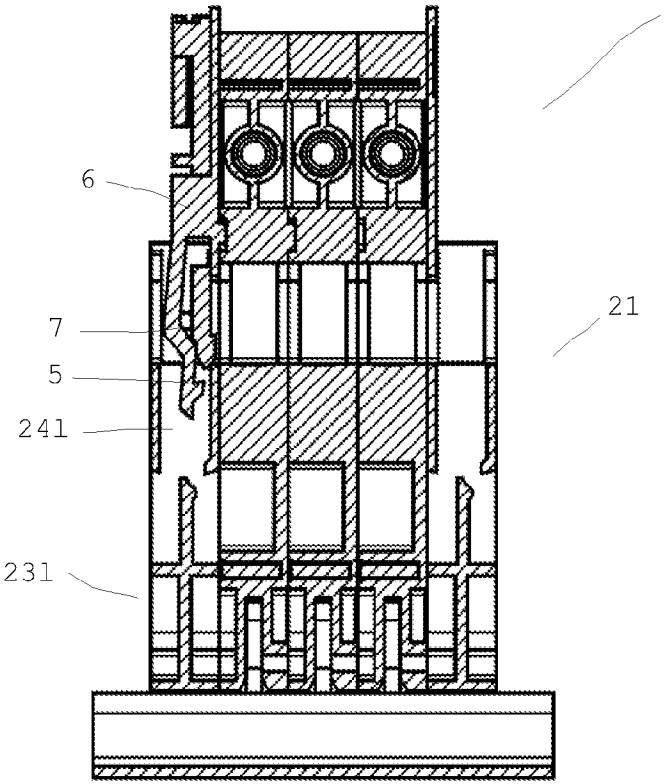

FIG. 2, which depicts the partial plugging in of the connecting plug 1 into the base terminal 21, shows how the tip section of the slide 7 comes into contact with one edge of the opening area of the receiving shaft, here 24*l*, of the base flange, here 23*l*.

Figure 3B:
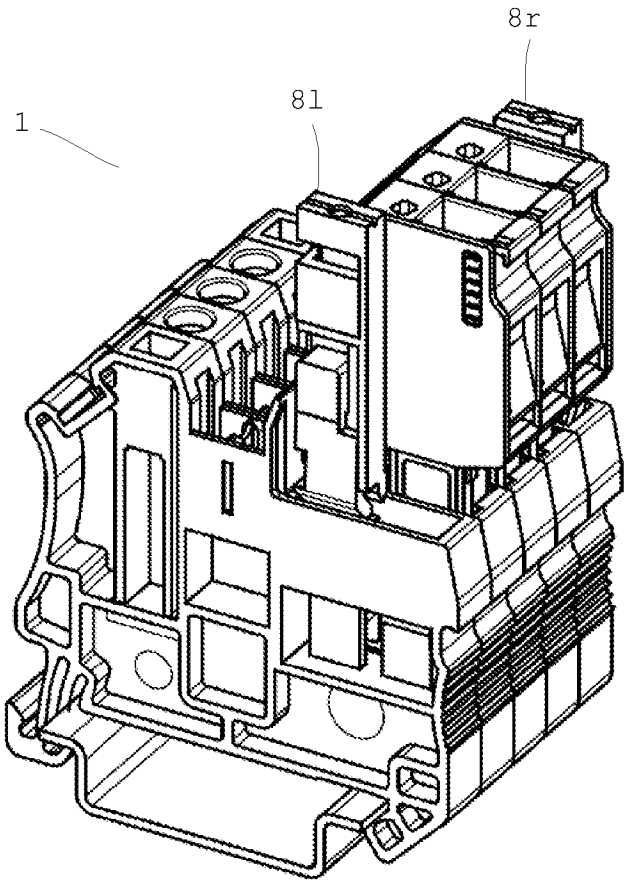
FIGS. 3*a*-3*b* show the connecting plug that is further partially plugged into the base terminal.
Figure 3A:
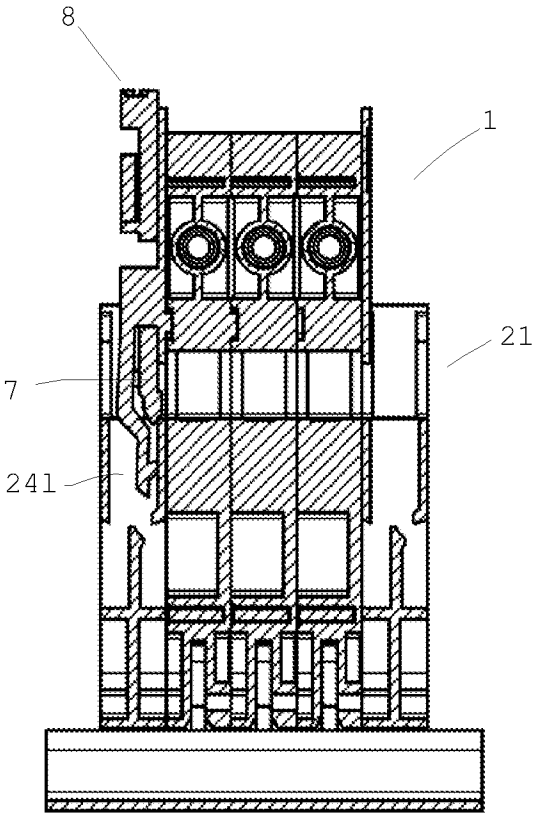

FIG. 3 also shows how the slide 7 is pushed upwards, so that its head part 8-8*l* and 8*r* in the perspective view according to b)—projects beyond the top part of the connecting plug. Since the latching hook 5 has the above-mentioned elastic pre-tensioning, the tip section of the slide 7 is also firmly pressed against the edge of the opening area of the receiving shaft 24*l*.

Figure 4B:
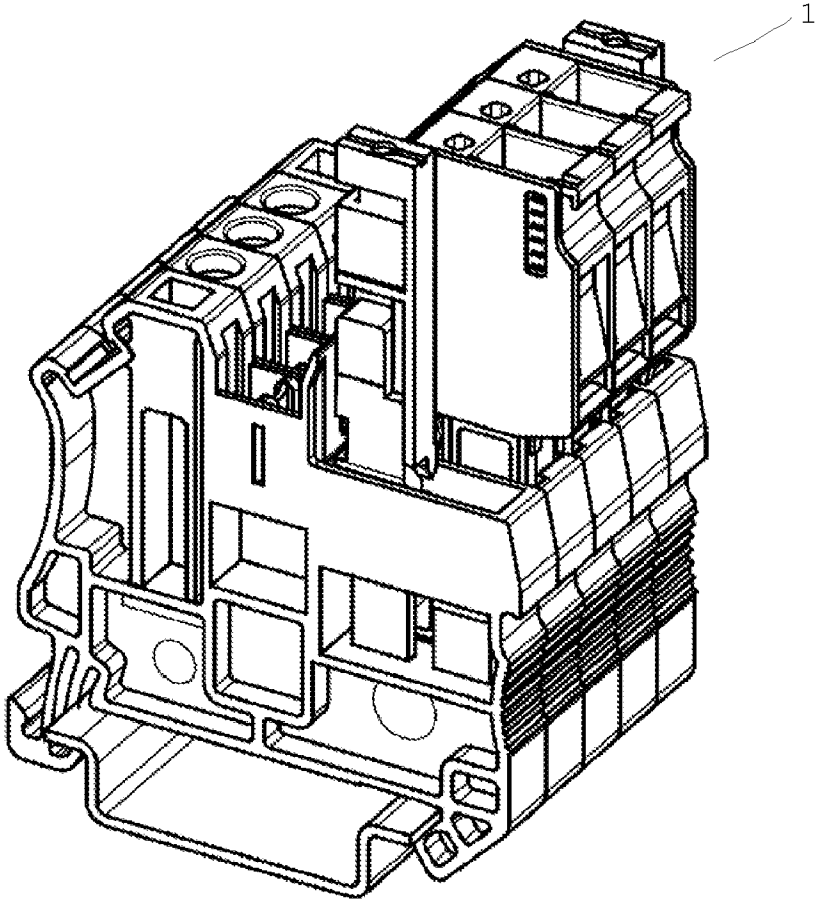
FIGS. 4*a*-4*b* show the connecting plug that is largely plugged into the base terminal.
Figure 4A:
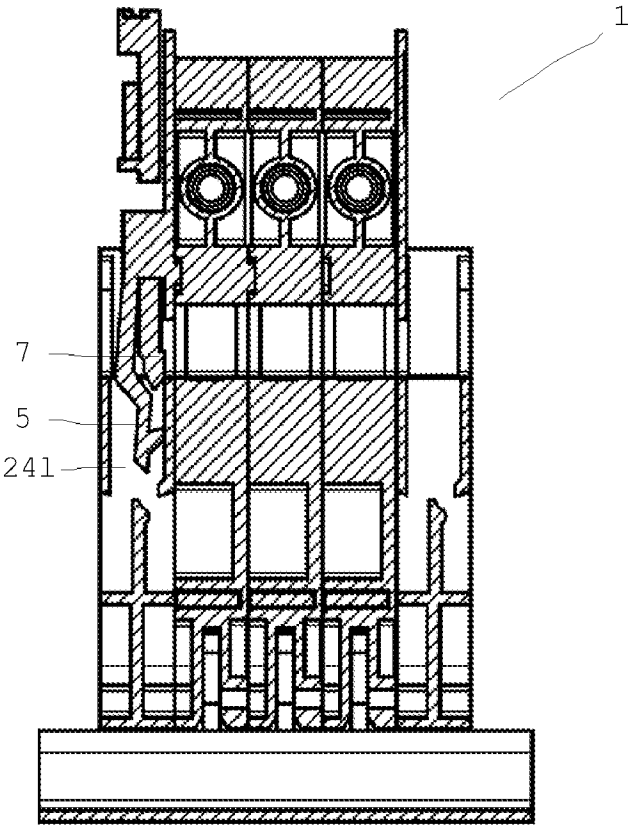

Moreover, FIG. 4 shows that the slide 7 retains its relative position with respect to the plug 1, while the latching hook 5 penetrates further into the receiving shaft 24*l*.

Figure 5B:
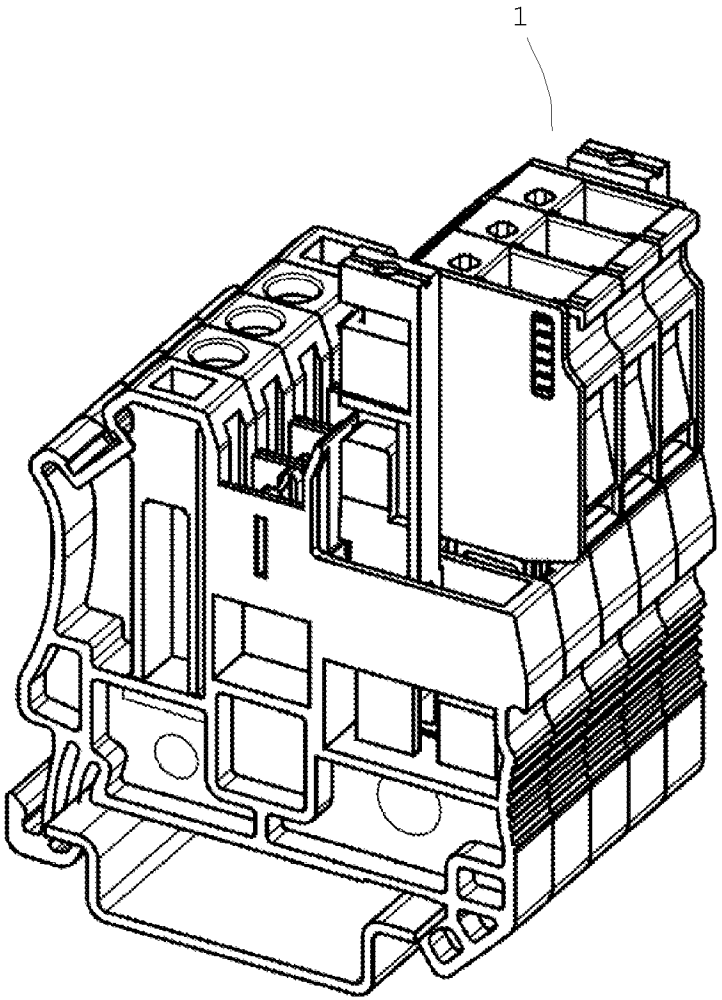
FIGS. 5*a*-5*b* show the connecting plug that is largely plugged into the base terminal, but that changes have occurred in the area of the latching hook.
Figure 5A:
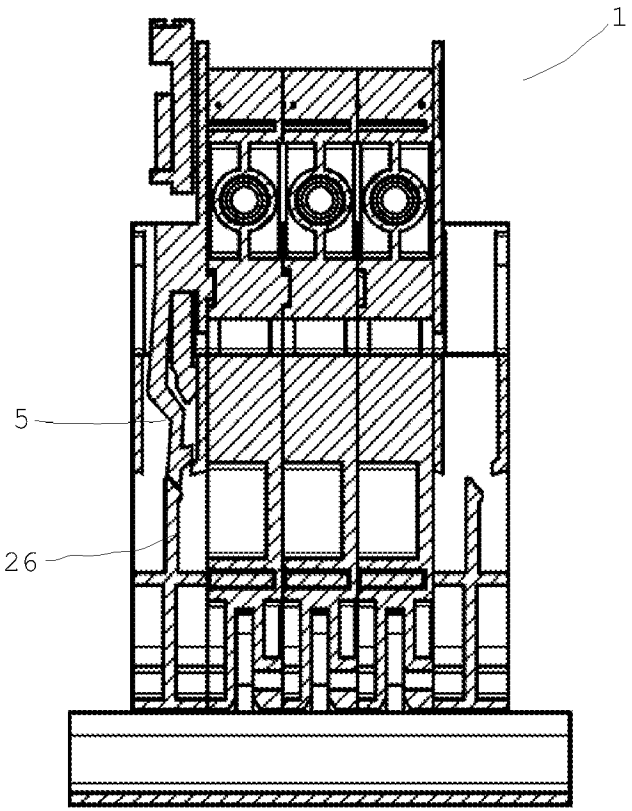

FIG. 5 shows a further penetration of the slide 7 and of the latching hook 5 into the receiving shaft 24. In particular, the sectional view a) illustrates that the tip of the latching hook 5 strikes against a spring arm 26—of the base flange 23—that is configured like a partition wall in the lower part of the receiving shaft.

Since the upper part of the spring arm 26 is tapered, as is shown in FIG. 6 in part a), it is deflected outward, especially since there is a shoulder 27 in the receiving shaft 24, and this shoulder 27 also deflects the tip of the latching hook 5 outward—that is to say, away from the block of the plug and base terminal parts.

FIG. 7 shows a continuation of the plugging-in procedure, illustrating how the latching hook 5 and the spring arm 26 are deflected further outward.

FIG. 8 then shows how the latching hook 5, assisted by the force exerted by the spring arm 26, ultimately latches below the above-mentioned shoulder 27 of the receiving shaft 24 into a free space 28 of the receiving shaft and the base terminal 21. The connecting plug is now plugged onto or into the base terminal 21 in such a way that a secure electric contact is established. Moreover, mechanically, the connecting plug 1 is also absolutely secured in the base terminal 21, whereby this secured state is automatically established when the plug unit is plugged in.

No tools are needed for this. A first stable secured position has been reached. The essential parts, namely, the latching hook 5, the guide shaft 6 or latching flange, the slide 7, the receiving shaft 24 of the base flange 23, the spring arm 26 and the space 28 below the shoulder 27 altogether form a securing device 30 (FIG. 1) whose first stable position is clearly visible in FIG. 8.

Figure 9B:
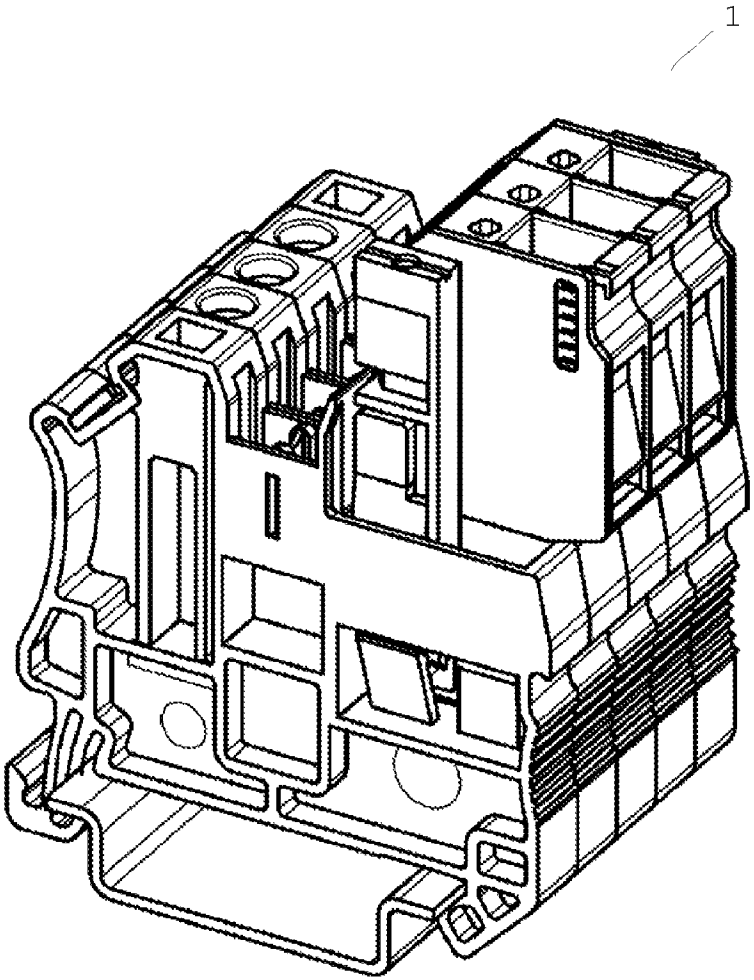
FIGS. 9*a*-9*b* show the connecting plug that is still completely plugged into the base terminal, while the latch has already been released.
Figure 9A:
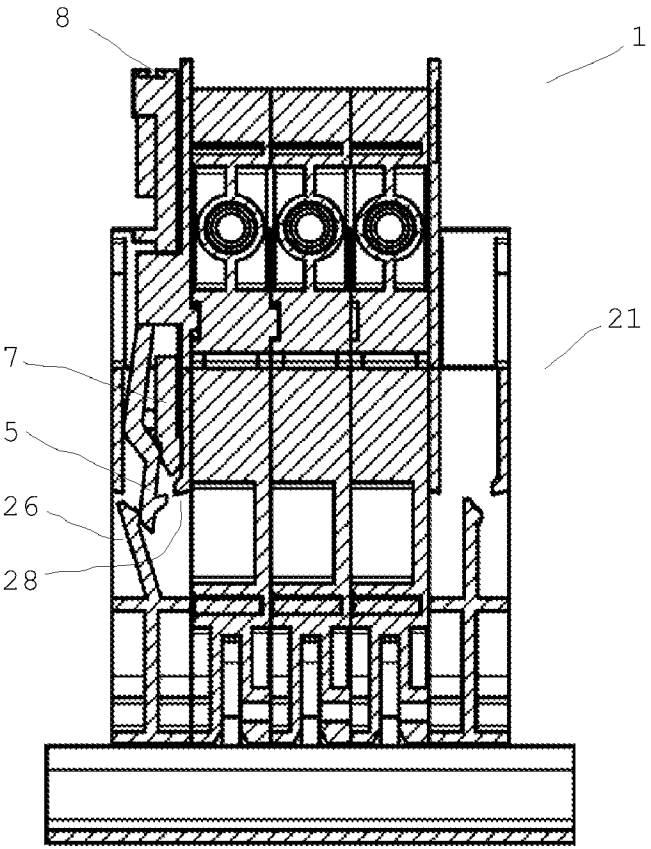

FIG. 9 describes a state illustrating the possibility that the connecting plug 1 can be unplugged from the base terminal 21, starting from its stable secured position. For this purpose, it is necessary to undo the secured position. In order to do so, it is provided according to the invention that the securing device 30 can be moved into an unlocked position or into a second stable position. In order to do this, pressure is exerted onto the head part 8 of the slide 7 shown in this embodiment until its lower end position is reached. As a result, the latching hook 5 is moved out of its secured position in that the tip of the slide pushes the latching hook 5 outward against the force of the spring arm 26 and against the elastic pre-tensioning of the latching hook 5, so that the barb of the latching hook 5 is pulled out of its engagement area out of the free space 28.

Through the design of the latching hook 5 as well as of the slide 7 inserted into its guide shaft 6, it can be achieved that the unlocked position is reliably reached, that is to say, the securing device 30 reaches a second stable position. The connecting plug 1 can be unplugged from the base terminal 21 without a button or the like having to be continuously depressed until the connecting plug 1 is matched with the base terminal 21, as shown in FIG. 1.

If the connecting plug is to be provided with two securing devices—on the left and right (30*l* and 30*r*)—the advantage of unplugging the connecting plug 1 without having to continuously actuate a button or the like is completely retained, since such a second securing device 30*r* also reliably reaches its unlocked position after brief pressure on the head part 8 of the appropriate slide 7.

Figure 10:
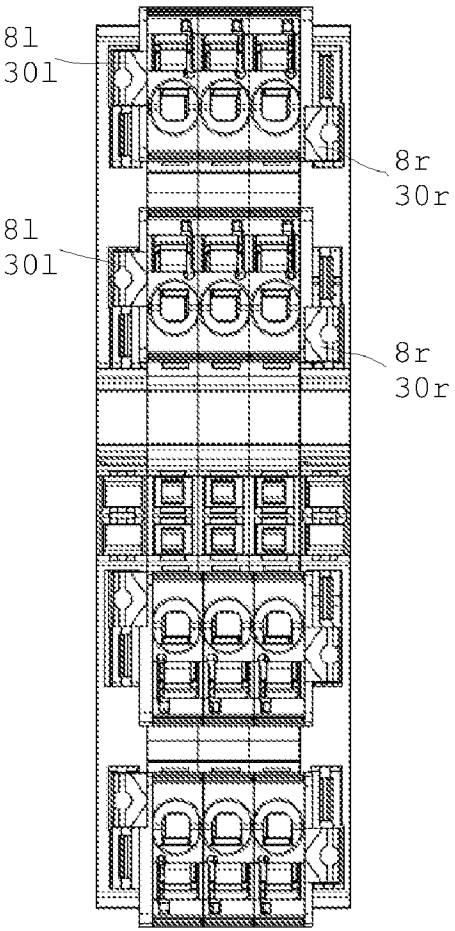
FIG. 10 shows a top view of an embodiment of a preferred design of the head parts of the slides for easier matching with the appertaining connecting plugs.

As can be seen in the top view in FIG. 10, an actuation head 8*l* or 8*r* matched with the securing device 30*l* and 30*r*, respectively, can be distinguished on the basis of its color and dimensions from a connecting plug that is adjacent on the left or right, so that the actuation heads 8*l* and 8*r* can easily be found by an operator, since they are matched to a certain connecting plug in a series of several connecting plugs, which can also have a second series of several connecting plugs parallel to it. In particular, the matched actuation head 8*l* or 8*r* can extend over the securing device or the plug, thus allowing a clear match.

In order to enlarge the installation space for the above-mentioned actuation heads, a base flange, which is located or provided underneath the connecting plug, can be have a thickened shape on the side of its wall that is facing the adjacent base terminal part.

To the extent that the description above names certain parts, which that are also mentioned in the list of reference numerals below and that appear in multiple versions—for example, since they are provided to the right and to the left when several plugs are lined up on matching base terminals or next to each other and crosswise to the direction in which they are lined up—but only describes them as a single part, this is done exclusively for the sake of clarity in the description and in the figures of the drawing; however, this is by no means to be construed as a restriction or as an incomplete disclosure of these structural parts that can be arranged in multiple ways, even if their individual parts have not been indicated by additional letters (such as l or r) or by a prime sign due to their being named multiple times.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

REFERENCE NUMERALS

1 connecting plug
2*a*, 2*b*, 2*c* plug terminal part
2*a-c* plug terminal block
3*l* left side wall
3*r* right side wall
5 latching hook
6 guide shaft (latching flange)
7 slide
7*a* side area (with enlarged cross section) of the slide
8 head part of the slide
8*l* head part of a slide to the left of a connecting plug
8*r* head part of a slide to the right of a connecting plug
10 shaft outlet opening (stop in latching flange)
11 tip of the slide
21 base terminal
22*a*, 22*b*, 22*c* base terminal part
22*a-c* base terminal block
23*l* base flange left
23*r* base flange right
24*l* receiving shaft (1), left
24'*l* receiving shaft (2), left
24*r* receiving shaft (1), right
24'*r* receiving shaft (2), right
26 spring arm
27 shoulder
28 free space
30 securing device

30*l* securing device to the left of a connecting plug
30*r* securing device to the right of a connecting plug

What is claimed is:

1. A securing device for a plug unit configured to automatically establish a secured state when the plug unit is plugged in, the securing device comprising:

an engagement element configured to automatically trigger the secured state through an engagement when the plug unit is plugged in, the automatically established secured state corresponding to a first stable position of the securing device; and an actuatable releasing device for unplugging the plug unit, the actuatable releasing device including a slide element and being configured to actuate so as to move the slide element against the engagement element so as to push the engagement element out of the engagement so as to undo the secured state and move the securing device into a second stable position, an unplugging and plugging in of the plug unit enabling the securing device to move out of the second stable position.

2. The securing device according to claim 1, wherein the actuatable releasing device is actuated from outside of the plug unit.

3. The securing device according to claim 2, wherein the actuatable releasing device is actuated towards a plug-in direction of the plug unit.

4. The securing device according to claim 1, wherein when the engagement element is released, the second stable position of the securing device is reached so that the plug unit is configured to be unplugged from a base unit.

5. The securing device according to claim 1, wherein a linearly guided element of the actuatable releasing device is pushed back into its initial position when the plug unit is plugged into a base unit, so that the second stable position of the securing device is undone.

6. The securing device according to claim 1, wherein a latching hook is provided as the engagement element that triggers the secured state and an effective force of the engagement of the latching hook is intensified by a springy element.

7. The securing device according to claim 1, wherein the plug unit is configured as a connecting plug and a base unit is configured as a base terminal of a series terminal.

8. The securing device according to claim 7, wherein the plug includes at least one side wall and one latching flange with a latching hook shaped onto it in one piece, wherein a slide is disposed in the latching flange, said slide also being connected to a head part which, when the actuatable releasing device is released, is configured to be actuated in such a way that one of an unlocked position and the second stable position is reached.

9. The securing device according to claim 8, wherein the actuatable releasing device is released towards a plug in direction of the plug unit.

10. A securing device for a plug unit configured to automatically establish a secured state when the plug unit is plugged in, the securing device comprising:

an engagement element configured to automatically trigger the secured state through an engagement when the plug unit is plugged in, the automatically established secured state corresponding to a first stable position of the securing device; and an actuatable releasing device configured to unplug the plug unit, the actuatable releasing device being configured to actuate so as to undo the secured state and move the securing device into a second stable position, an unplugging and plugging in of the plug unit enabling the securing device to move out of the second stable position, wherein the plug unit is configured as a connecting plug and a base unit is configured as a base terminal of a series terminal, wherein the plug includes at least one side wall and one latching flange with a latching hook shaped onto it in one piece, wherein a slide is disposed in the latching flange, said slide also being connected to a head part which, when the actuatable releasing device is released, is configured to be actuated in such a way that one of an unlocked position and the second stable position is reached, wherein at least one lateral base flange is provided on the base terminal, whereby the latching flange is configured to be inserted into the at least one lateral base flange so that the latching hook formed thereon engages in a free space underneath a shoulder of a receiving shaft, whereby a spring arm that intensifies an engagement force of each latching hook is provided in the appertaining receiving shaft.

11. The securing device according to claim 10, wherein each lateral base flange attached on each side has two receiving shafts, so that latching flanges of adjacent connecting plugs are inserted into one of the receiving shafts.

12. The securing device according to claim 11, wherein the base terminal includes left and right base flanges laterally disposed thereon, the base terminal further including corresponding securing devices.

13. The securing device according to claim 12 wherein a matching connecting plug includes matching left and right latching flanges, head parts of the matching left and right latching flanges being configured to be distinguished on the basis of color and size from the plugs that are adjacent to them.

14. The securing device according to claim 12, in which the securing device projects beyond respective head parts of the matching left and right latching flanges.

* * * * *